US006494389B1

(12) United States Patent
Reiter

(10) Patent No.: US 6,494,389 B1
(45) Date of Patent: Dec. 17, 2002

(54) FUEL INJECTION VALVE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,143

(22) PCT Filed: Jul. 13, 2000

(86) PCT No.: PCT/DE00/02277

§ 371 (c)(1),
(2), (4) Date: Jun. 15, 2001

(87) PCT Pub. No.: WO01/06113

PCT Pub. Date: Jan. 25, 2001

(30) Foreign Application Priority Data

Jul. 14, 1999 (DE) ..... 199 32 763

(51) Int. Cl.[7] ..... F02M 51/00

(52) U.S. Cl. ..... 239/585.1; 239/585.2; 239/585.3; 239/585.4; 239/585.5; 251/129.15; 251/129.21

(58) Field of Search ..... 239/585.1, 585.2, 239/585.3, 585.4, 585.5, 900; 251/129.15, 129.21

(56) References Cited

U.S. PATENT DOCUMENTS 4,552,311 A 11/1985 Casey
4,597,558 A * 7/1986 Hafner et al. ..... 239/585.1
4,666,088 A * 5/1987 Krauss et al. ..... 239/585.3
4,733,822 A * 3/1988 Romann ..... 239/585.3
4,800,912 A * 1/1989 Hafner et al. ..... 239/585.3
4,946,107 A * 8/1990 Hunt ..... 239/585.4

FOREIGN PATENT DOCUMENTS

| | | |
|---|---|---|
| DE | 195 47 406 | 6/1997 |
| DE | 196 32 196 | 2/1998 |
| EP | 0 690 224 | 1/1996 |

* cited by examiner

*Primary Examiner*—Robin O. Evans
(74) *Attorney, Agent, or Firm*—Kenyon & Kenyon

(57) ABSTRACT

A fuel injector including a fuel intake, having an excitable actuating device using which a valve-closure member can be moved, having a fixed valve seat configured on a valve seat element, with which valve-closure member cooperates for opening and closing the valve. Also included in the fuel injector are a fuel outlet provided downstream of the valve seat, and a sleeve-shaped connecting part, that has an interior longitudinal opening and that receives the valve seat element. The thin-wall connecting part has formations that increase the rigidity and prevent a bending or a folding of the connecting part, the formations being executed in the shape of longitudinal creases. The valve is particularly well-suited for use in fuel injection systems of mixture-compressing, spark-ignited internal combustion engines.

9 Claims, 2 Drawing Sheets

FUEL INJECTION VALVE

FIELD OF THE INVENTION

The present invention relates to a fuel injector.

BACKGROUND INFORMATION

German Published Patent Application No. 196 32 196 describes a fuel injector which is designed so as to be very slim in order to extend, for example, at its spray-side valve end, into an induction pipe of an internal combustion engine. The electromagnetically actuatable valve is distinguished by the fact that both a valve seat support as well as a valve needle are configured in an elongated fashion. Therefore, the spray-discharge point of the valve is set far forward, thus making possible a very controlled spray discharge. A connecting part of the valve needle, connecting the armature and the valve-closure member, is designed as a stamping-bending part and, over the greatest part of its axial extension, has an open profile, deviating from a circular cross-section. The valve seat support is designed as a sleeve-like, thin-wall component.

European Published Patent Application No. 0 690 224 describes a fuel injector which has a nozzle opening, which, when the valve is installed, is already situated in the interior of an intake port, so that, while avoiding wetting the wall, a spray discharge is possible that is substantially directed at an intake valve of an internal combustion engine. The forward placement of the spray-discharge point increases the mass and the volume of the injector by elongating the solidly designed valve seat support.

SUMMARY OF THE INVENTION

The fuel injector according to the present invention has the advantage that, in comparison to the known elongated valves increased rigidity, is achieved simply and cost-effectively. Twisting or bending the spray-discharge-side valve end is advantageously prevented. The valve end has a high resistance to bending and folding. As a result of the increased strength of the thin-wall connecting part of the fuel injector according to the present invention, the connecting part being used as the valve seat support, it is possible to operate a fuel injector of this type even at system pressures that are higher with respect to the induction pipe injection. The fuel injector according to the present invention is therefore especially suited, as a so-called direct-injection valve, for directly injecting fuel into a combustion chamber of a mixture-compressing, spark-ignited internal combustion engine.

It is particularly advantageous to introduce, over the circumference of the connecting part, a plurality of longitudinal depressions in the form of elongated creases.

DETAILED DESCRIPTION

Figure 1:
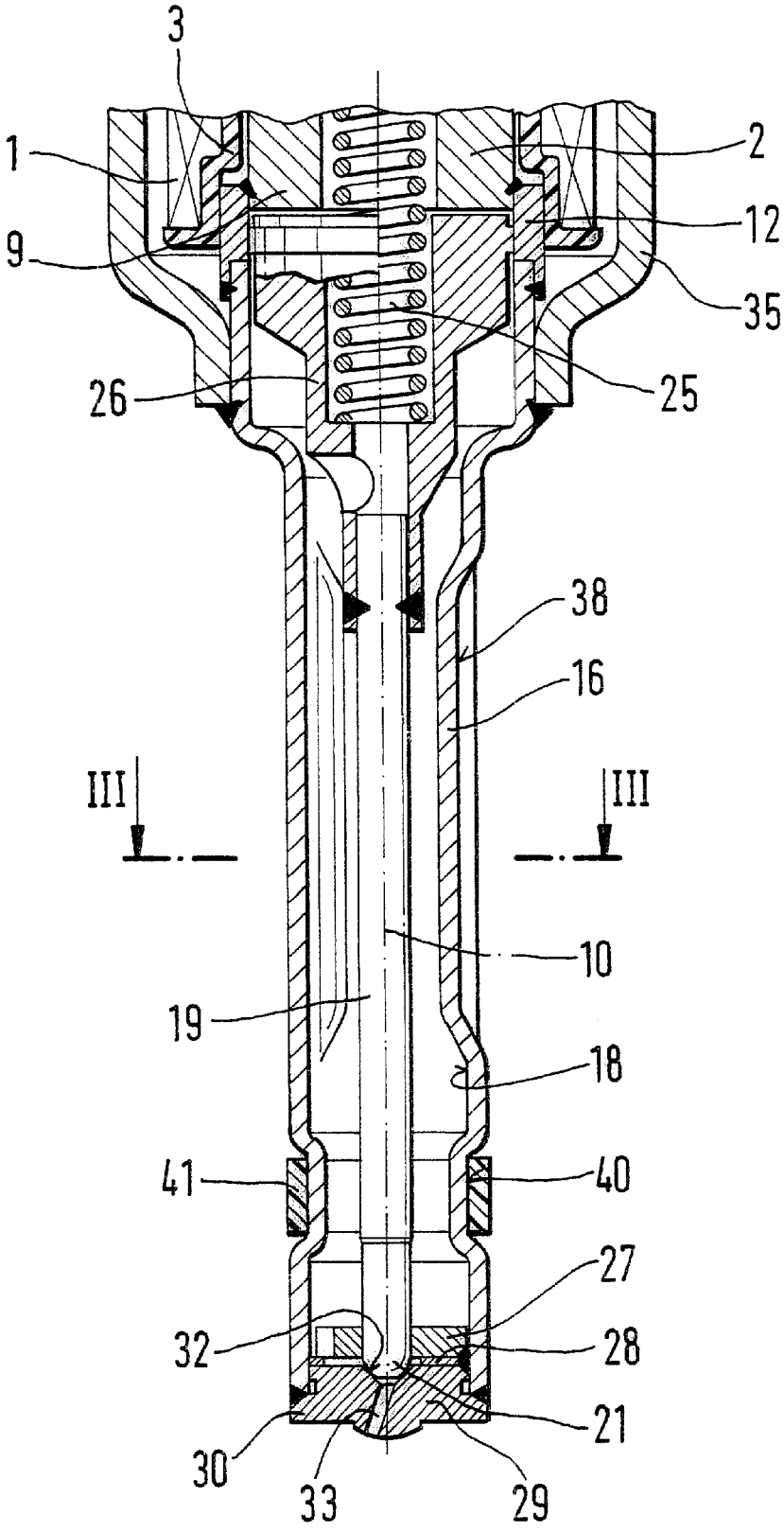
FIG. 1 depicts a first exemplary embodiment of a valve configured in accordance with the present invention.

The electromagnetically actuatable valve, partially represented in FIG. 1 in the form of a fuel injector for fuel injection systems in mixture-compressing, spark-ignited internal combustion engines, is especially suited for the direct injection of fuel into an undepicted combustion chamber. The fuel injector has a tubular core 2, as the so-called internal pole, surrounded by a solenoid coil 1. A coil form 3 receives a winding of solenoid coil 1 and, in conjunction with core 2, makes possible a particularly compact design of the injector in the area of solenoid coil 1. In place of an electromagnetic circuit, piezo actuators or magnetostrictive actuators are also suitable as the excitable actuating elements.

A tubular, metallic intermediate part 12 is tightly joined, for example by welding, to a lower core end 9 of core 2 so as to be concentric with respect to a valve longitudinal axis 10, and the intermediate part axially partially surrounds core end 9. Extending downstream of coil form 3 and of intermediate part 12 is a tubular valve seat support 16 in accordance with the present invention, which, by way of example, is fixedly joined to intermediate part 12. In valve seat support 16, which is used as a connecting part and represents a tubular and thin-wall sleeve, there is a longitudinal opening 18. Arranged in longitudinal opening 18 is a valve needle 19, e.g., rod-shaped, which has a valve-closure segment 21 at its downstream end.

Actuation of the injector takes place in a known manner, e.g., electromagnetically. Used for the axial motion of valve needle 19 and therefore for opening the injector, in opposition to the spring tension of a resetting spring 25, and for closing it is the electromagnetic circuit having solenoid coil 1, core 2, and armature 26. Armature 26 is joined by a welded seam to the end of valve needle 19, which is facing away from valve-closure segment 21, and the armature is aligned with core 2. In the end of valve seat support 16, situated downstream and facing away from core 2, a guide and seat unit is fixedly installed in longitudinal opening 18 by welding.

This guide and seat unit includes three disk-shaped elements, which at their end faces are directly contacting each other. In this context, a guide element 27, a swirl element 28, and a valve seat element 29 follow in the downstream direction. Whereas guide element 27 and swirl element 28 are entirely arranged within longitudinal opening 18, valve seat element 29 having a stepped exterior contour only partially extends into longitudinal opening 18. In the area of a shoulder 30, extending to the outside, valve seat element 29 is joined fixedly and tightly to valve seat support 16 at the latter's downstream end face. Guide element 27, swirl element 28, and valve seat element 29 are also fixedly joined to each other, a welded seam on the exterior circumference of the three elements 27, 28, and 29 being created for this purpose.

To guide valve needle 19 during the axial motion along valve longitudinal axis 10, there is a guide opening of intermediate part 12 as well as a guide opening in guide element 27. Valve-closure segment 21, e.g., tapering downstream to a hollow cone, cooperates with a valve seat surface 32 of valve seat element 29, tapering to a hollow cone in the direction of flow. Emerging from valve seat surface 32, at least one outlet opening 33 extends through valve seat element 29. In the exemplary embodiment depicted, outlet opening 33 is tilted diagonally with respect to valve longitudinal axis 10, which terminates in a spray-discharge area of valve seat element 29, having a convex curvature. The fuel flowing through outlet opening 33 is swirl-impacted, because a swirl component, that improves atomization, is induced in the fuel upstream of valve seat surface 32 in swirl element 28, in which, for example, a plurality of tangentially running swirl channels are provided.

When solenoid coil 1 is not excited, an end position of valve needle 19 is established by the contact of valve-closure segment 21 on valve seat surface 32, whereas when solenoid coil 1 is excited, the other end position of valve needle 19 results from the contact of armature 26 on core end 9 of core 2. Solenoid coil 1 is surrounded by pot-shaped valve housing 35, which is used as a so-called external pole. At its lower end facing valve seat element 29, valve housing 35 is fixedly attached to valve seat support 16, e.g., by a welded seam.

Valve seat support 16, made of, e.g., a ferritic, magnetic-flux-conductive material, surrounds the axially movable valve part composed of armature 26 and valve needle 19 having valve-closure segment 21, as well as partially the guide and seat unit. Valve seat support 16 is designed so as to be elongated, valve seat support 16 making up one half or more of the entire axial longitudinal extension of the injector. On the basis of this design of valve seat support 16, the spray-discharge point of the injector can be set far forward, which can be desirable in certain internal combustion engines on account of special form designs and limited installation space. When the fuel injector is used as a direct injector, the spray-discharge point can therefore be optimally placed at a desired location in the combustion chamber. In the usual installation positions of injectors for the intake injection, a design of this type signifies that the fuel injector at its downstream end, and therefore in its measuring and spray-discharge area, extends perceptibly into the intake pipe. As a result, wetting of the wall of the intake pipe is largely avoided is a result of the spray discharge being directed at one or a plurality of intake valves, and as a consequence thereof, the exhaust-gas emissions of the internal combustion engine can be reduced.

By using the relatively inexpensive sleeve for valve seat support 16, it is possible to do without the rotating parts that are customary in injectors, which due to their larger exterior diameters are more bulky and more expensive to manufacture than valve seat support 16. However, in designing a fuel injector having elongated, thin-wall valve seat support 16, there exists a certain danger of bending or folding the spray-discharge-side valve end. On the basis of the design according to the present invention of valve seat support 16, rigidity is increased, so that, in an advantageous manner, twisting or folding the spray-discharge-side valve end is prevented.

Distributed over the circumference, valve seat support 16 has formations in the shape of longitudinal creases 38, which increase the rigidity. FIG. 3, as a sectional view of a cutaway cross-section along the line III—III in FIG. 1, depicts an example of a valve seat support 16 having three longitudinal creases 38. In this context, longitudinal creases 38, extending in the axial direction, are introduced, e.g., spaced 120° from each other. Both a smaller and a larger number of longitudinal creases 38 are also conceivable. Longitudinal creases 38 represent, with respect to the actual sleeve shape, recessed formations, which can run over a significant portion (e.g., as depicted in FIGS. 1 and 2, over roughly 50%) of the axial longitudinal extension of valve seat support 16.

Valve seat support 16 can be manufactured, on the one hand, in a deep drawing process or, on the other hand, by a tube-reshaping process. For reshaping a tubular starting member, it is possible to use, e.g., hydromechanical or hydrostatic reshaping processes. The desired shape of valve seat support 16 can also be achieved using magnetic reshaping.

A sealing element 41, arranged in a groove 40 that is introduced on the exterior circumference of valve seat support 16, is used for a gasket seal between the circumference of the injector and an undepicted valve receptacle in the cylinder head, or on a suction line of the internal combustion engine. Sealing element 41 is manufactured, e.g., from a plastic such as PTFE. The radial depth of groove 40 corresponds, for example, to the depth of longitudinal creases 38.

Figure 2:
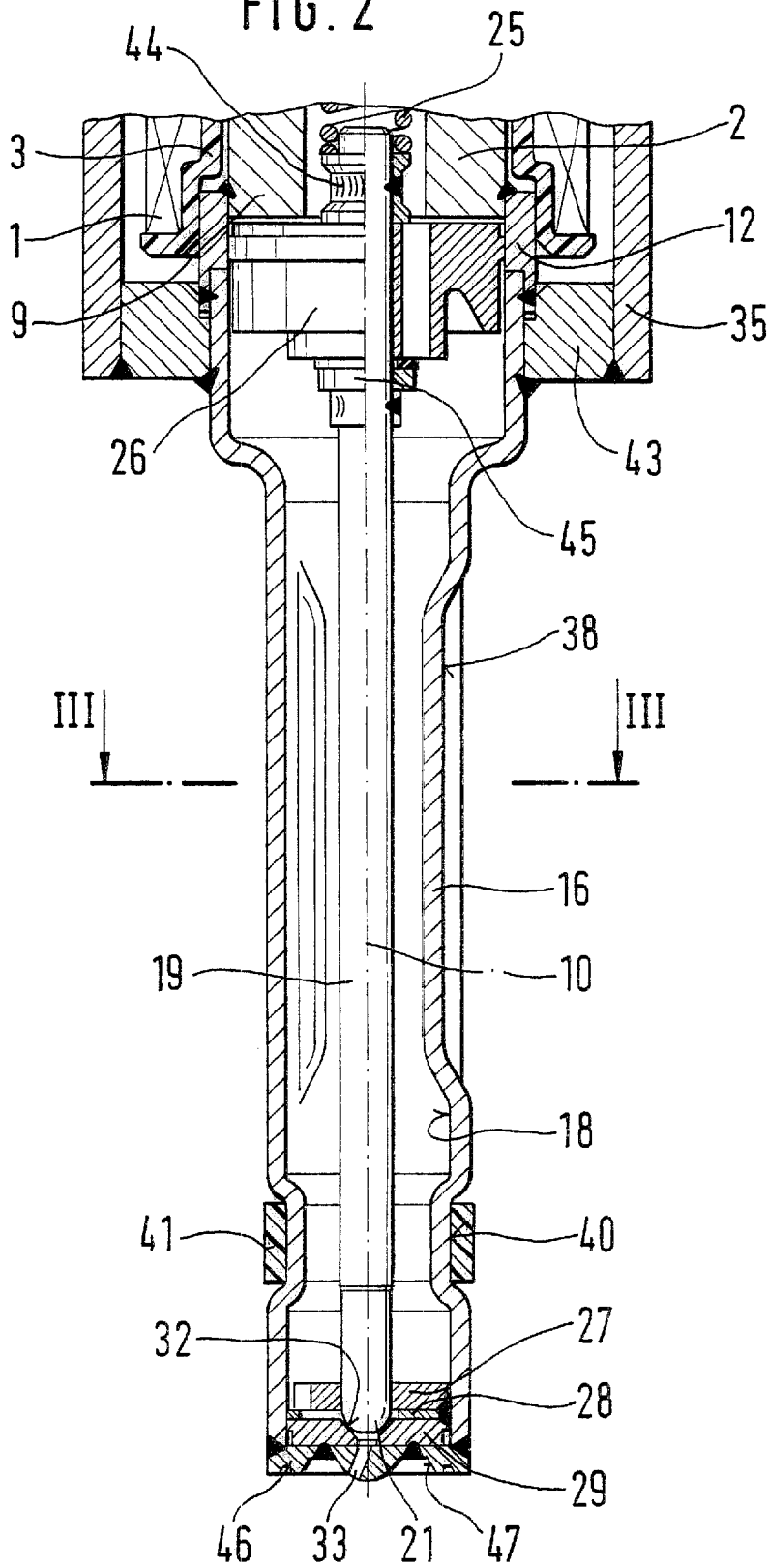
FIG. 2 depicts a second exemplary embodiment of a valve configured in accordance with the present invention.
Figure 3:
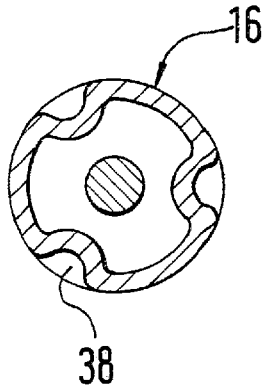
FIG. 3 depicts a cutaway view of the valve seat support along the line III—III in FIG. 1 and FIG. 2.

FIG. 2 depicts a second exemplary embodiment of a fuel injector, which essentially conforms with the valve depicted in FIG. 1. In what follows, only the differences are discussed. Valve housing 35 in this design is configured in a pot-shaped manner, such that it does not immediately contact valve seat support 16. Rather, beneath solenoid coil 1, a base part 43, closing the magnetic flux, is provided, to which both valve housing 35 as well as valve seat support 16 are fixedly joined. Armature 26 is arranged, for example, so as to be axially movable on valve needle 19 between an upper and a lower needle-fixed limit stop 44 and 45. To avoid valve needle 19 bouncing in response to the closing of the valve, a damping element is introduced, e.g., between armature 26 and lower limit stop 45.

The guide and seat unit is also configured with insignificant modifications. Guide element 27, swirl element 28, as well as valve seat element 29 are arranged entirely within longitudinal opening 18. Downstream of valve seat element 29, a disk-shaped spray-discharge body 46 is provided. In this case, spray-discharge body 46 has outlet opening 33. Spray-discharge body 26 and valve seat element 29 are fixedly joined to each other, e.g., by a welded seam generated by laser welding, the welding being undertaken in an annular recession 47. Spray-discharge body 46 is also fixedly joined to valve seat support 16 by a welded seam.

What is claimed is:

1. A fuel injector, comprising:

a fuel inlet;

a valve seat element;

a fixed valve seat configured on the valve seat element;

a valve-closure member cooperating with the fixed valve seat for opening and closing a valve, an excitable actuating device for moving the valve-closure member;

a fuel outlet provided downstream from the fixed valve seat; and a sleeve-shaped connecting part including an interior longitudinal opening and for receiving the valve seat element, wherein:

the sleeve-shaped connecting part includes formations that increase a rigidity, and the formations are in a shape of longitudinally running depressions.

2. The fuel injector according to claim 1, wherein:

the sleeve-shaped connecting part includes a substantially annular cross-section, and the formations are recessed with respect to an annular circumference.

3. The fuel injector according to claim 1, wherein:

more than one of the formations are introduced over a circumference of the sleeve-shaped connecting part.

4. The fuel injector according to claim 1, wherein:

the formations are configured as longitudinal creases.

5. The fuel injector according to claim 1, wherein:

the sleeve-shaped connecting part is shaped in accordance with a deep drawing operation.

6. The fuel injector according to claim 1, wherein:

the sleeve-shaped connecting part is shaped from a tube in accordance with one of a hydromechanical operation and a hydrostatic reshaping operation.

7. The fuel injector according to claim 1, wherein:

the sleeve-shaped connecting part is shaped from a tube in accordance with a magnetic reshaping operation.

8. The fuel injector according to claim 1, wherein:

the sleeve-shaped connecting part includes a ferritic, magnetic-flux-conductive material.

9. The fuel injector according to claim 1, wherein:

the formations extend over approximately one half of an axial longitudinal extension of the sleeve-shaped connecting part.

* * * * *